US006543213B1

(12) United States Patent
Khu

(10) Patent No.: US 6,543,213 B1
(45) Date of Patent: Apr. 8, 2003

(54) METHOD AND APPARATUS FOR MANUFACTURING ROPES, CABLES OR THE LIKE

(75) Inventor: Peter Khu, Vienna (AT)

(73) Assignee: Peter Khu Sondermaschinenbau GmbH, Hagenbrunn-Industriegebiet (AT)

( * ) Notice: Subject to any disclaimer, the term of this patent is extended or adjusted under 35 U.S.C. 154(b) by 0 days.

(21) Appl. No.: 09/512,392

(22) Filed: Feb. 24, 2000

(51) Int. Cl.[7] ..... H01B 13/08
(52) U.S. Cl. ..... 57/6; 57/3
(58) Field of Search ..... 57/1 R, 3, 6, 10, 57/11, 12, 13, 16, 17, 18, 200, 210, 211, 230, 235, 260; 174/110 R, 113 C, 121 R, 124 R

(56) References Cited

U.S. PATENT DOCUMENTS 4,024,696 A * 5/1977 Towsend ..... 57/3

* cited by examiner

*Primary Examiner*—Danny Worrell
*Assistant Examiner*—Shaun R Hurley

(74) *Attorney, Agent, or Firm*—Sonnenschein Nath & Rosenthal

(57) ABSTRACT

The invention is directed to a method for manufacturing ropes, cables or the like, whereby an envelope of a flexible, web-shaped material, for example paper, is produced around at least one central core, for example a conductor, moved in the direction of its longitudinal axis, and the structure that has arisen in this way is stranded in a traditional way while being moved, for example with a SZ stranding, whereby at least one further layer of plastic material can also be applied onto the moving, stranded structure in any case, preferably by extrusion. So that a complete and dependable enveloping of a central core can be produced before a following stranding, even given systems running at high speed and continuously and given systems with a changing rotational sense of the stranding, the material for the envelope is supplied in the form of a band with the same speed as the moving core and, finally, is directed parallel to the core, whereas at least two longitudinal structures that are essentially parallel to one another and to the longitudinal axis of the band and that reduce the flexural strength of the band are worked into the band during the delivery thereof, and the band, following the alignment parallel to the core and before the stranding, is automatically bent around the core at least twice at its longitudinal structures such that a closed sheath arises around the central core.

33 Claims, 4 Drawing Sheets

METHOD AND APPARATUS FOR MANUFACTURING ROPES, CABLES OR THE LIKE

BACKGROUND OF THE INVENTION

The invention is directed to a method for manufacturing ropes, cables or the like, whereby an envelope of a flexible, web-shaped material, for example paper, is produced around at least one central core, for example a conductor, moved in the direction of its longitudinal axis, and the structure that has arisen in this way is stranded in a traditional way while being moved, for example with a SZ stranding, whereby at least one further layer of plastic material can also be applied onto the moving, stranded structure in any case, preferably by extrusion; the invention is also directed to an apparatus for the implementation of the method, i.e. for the manufacture of ropes, cables or the like, comprising a means for moving a central core, for example a conductor, in the direction of its longitudinal axis, delivery means for a flexible, web-shaped material, for example paper, in the immediate proximity of the moving core and parallel thereto, and comprising at least one following guide means for forming a closed envelope of the web-shaped material around the core, as well as a stranding mechanism, for example an SZ stranding mechanism, and, in any case, also at least one extrusion means for applying a further layer of plastic material onto the moving, stranded structure.

There are many applications wherein a rope, a cable or the like must be manufactured in such a way that an envelope is produced around the central core by stranding, whereby an intermediate layer composed of a thin, typically web-shaped material is also provided between this core and the envelope. For instance, the ground conductor in electrical cables is often wrapped with paper, after which the stranding occurs. This can ensue, for example, with the method of SZ stranding, whereby the conductors are conducted through a perforated disk with rapidly changing rotational sense, so that the drums for the fibers of the envelope need not be moved around the central core. There are, however, other methods where this occurs and that thereby produce a stranding with only one rotational sense. In order to then apply the intermediate layer of paper onto the central core or, respectively, the conductor, it has already been proposed to wrap a paper strip around the core oriented obliquely relative to the longitudinal axis of the cable; this, however, causes particular difficulties given extremely high-speed systems. Paper strips that are supplied in longitudinal direction and run with the speed of the cable have likewise been disclosed, these being folded once in length and around the central core. It is thereby disadvantageous that this envelope is not symmetrical around the longitudinal axis of the cable and is also open at one side, so that problems relating to the complete covering of the core derive over and over again, specifically in high-speed systems.

SUMMARY OF THE INVENTION

An object of the present invention was therefore to improve a method of the type initially cited such that, while avoiding the above-described disadvantages and problems of the prior art, a complete and dependable envelope of a central core can be produced before a following stranding, even given systems that run at high speed and continuously and given systems with changing rotational sense of the stranding. A further goal of the invention was to implement an apparatus as initially set forth such that a complete and dependable enveloping of a central core can be produced in a fast and dependable way before a following stranding and such that it is suitable for very fast operation, i.e., fast and continuous throughput of the cable, even with changing rotational sense of the stranding.

For achieving the first object, the initially described method is characterized in that the material for the envelope is supplied in the form of a band with the same speed and, finally, is directed parallel to the core, such that at least two longitudinal structures that are essentially parallel to one another and to the longitudinal axis of the band and that reduce the flexural strength of the band are worked into the band, and such that the band, following the alignment parallel to the core and before the stranding, is automatically bent around the core at least twice at its longitudinal structures such that a closed sheath arises around the central core. Due to the equally fast delivery of the material for the envelope and the parallel alignment, the delivery speed need not be any higher than the throughput speed of the cable through the system, so that very high values thereof can be achieved. Working the longitudinal structures in, which reduces the risk of tearing, is thereby still possible in a relatively simple way. The two-time bending or, respectively, folding of the band in longitudinal direction yields a hollow profile structure, at least a structure with a triangular cross section of the material of the envelope that surrounds the core without gaping regions and, thus, dependably covers it on all sides and that is also not pressed open during the course of the following stranding.

It is provided according to a further feature of the invention that the longitudinal edges of the band lying opposite one another overlap after being bent around the core. The hold of the closed structure completely enveloping the core is thus improved further and a gaping thereof is prevented to the farthest-reaching extent.

The most dependable hold of the hollow structure composed of the structure folded or, respectively, bent around the central core in longitudinal direction is established when the overlapping longitudinal edges of the band are joined to one another at least at points. This can be achieved, for example, by gluing, punctiform as well, or by any other desired joining technique such as basting, sewing, clamping, etc.

The simplest processing for preserving a closed structure around the central core can be achieved in that at least two grooves are produced as longitudinal structures. The band can then be folded twice in the same direction in the region of these grooves, so that a hollow structure with a triangular cross section arises, which, given a corresponding arrangement of the grooves, can also be fashioned symmetrically with respect to its longitudinal axis.

It is advantageously provided according to a further feature of the invention that a plurality of grooves are produced on both sides of the band and the band is multiply folded, and that, during the course of bending the folded band around the core and the overlapping of the longitudinal edges, at least one groove of a longitudinal edge engages into a groove of the longitudinal edge lying opposite. A tighter wrapping of the central core with less unused cross section and, thus, a reduced need for material is thereby possible. Due to the plurality of grooves, the bending and, thus, the stressing of the material in the region of each and every groove is lower, so that a greater protection against damage is established, this being of particular significance given high-speed systems.

Given the aforementioned version of the method, an optimum protection against unwanted unraveling or gaping of the envelope can be achieved in that an overlap of a plurality of grooves is produced at each longitudinal edge. Of course, an at least punctiform, additional joining by gluing, basting, sewing or similar methods is thereby also advantageous and additionally enhances the durability of the envelope.

As provided in an advantageous version of the invention, grooves having a v-shaped cross section can be especially simply and easily formed.

It is provided according to a further feature of the invention that the envelope of the band-shaped material that surrounds the central core and is already closed is guided at essentially all sides between at least one location at which the completely closed configuration has been essentially achieved and the entry into a following stranding device. Particularly for high-speed stranding systems, maintaining the closed configuration and protection against subsequent changes are thus established.

For achieving the second object, the system for manufacturing ropes, cables or the like according to the present invention is characterized in that a guide roller oriented parallel to the moving direction of the core is provided for the band-shaped material, and that at least one tool is provided that works at least two parallel, longitudinal structures into the band at least one location at which the band lies on the guide roller. The guide roller allows an optimum guidance and alignment of the band and, due to the slight free length of the band from when it lifts off from the roller—advantageously arranged close to the core—until the closed envelope has been finished, the risk of damage to or, respectively, tearing of the band is reduced to the farthest-reaching extent. This latter risk is also significantly reduced in that the tool for working the longitudinal structures in acts on the band where it is still lying against the guide roller and is thereby dependably guided and supported. The dependable guidance on the guide roller also increases the precision of the processing, then facilitates the following bending-over or folding to form the structure enveloping the core and the exact dimensioning of this structure.

Advantageously and according to a further feature of the invention, the circumferential surface of the guide roller in which the band lies is provided with at least one circumferential channel, and the tool is composed of at least one shaping roller pressed against the circumferential surface of the guide roller, the circumferential surface of said shaping roller being complementary to the circumferential channel in the guide roller.

In order to be able to produce a structure that can be easily bent around the core and that is nonetheless stable and durable, it is provided according to another feature of the invention, that the circumferential surface of the guide roller comprises at least two, preferably a plurality of circumferential grooves. The stressing of the band in the region of the individual grooves is correspondingly reduced, specifically given many grooves lying next to one another, and the following bending or folding in this region produces less stress on the material than given a very small number of grooves and a correspondingly greater bending of these few grooves.

A further distribution of the stressing of the material when shaping the grooves in the band-shaped material for the envelope can be achieved in that at least two shaping rollers are provided, each one thereof carrying a plurality of beads or burrs along its circumference that each respectively engage into a circumferential groove of the guide roller and that are fashioned complementary to these circumferential grooves, whereby the plurality and arrangement of the beads or burrs is selected such that each circumferential groove of the guide roller collaborates with at least one bead or burr. The stressing is thus also distributed along the path of the band on the guide roller and, thus, the risk of damage is reduced further.

The least possible stressing of the band and the greatest possible security against damage in the shaping of the grooves is established when each shaping roller is provided with only one bead or burr and a plurality of shaping rollers corresponding in number to the plurality of circumferential grooves in the guide roller and distributed over the circumferential region is provided, the band also lying on the guide roller via these.

A very simple and economically manufacturable device is characterized in that the circumferential grooves comprise a v-shaped cross section and the shaping rollers comprise corresponding beads with an angular cross section.

Advantageously, at least one guide means is also additionally provided, preferably in the form of a pipe that extends between—essentially—the location at which the envelope is essentially closed and the stranding means. As a result of this measure, it can be assured—even given high-speed stranding systems—that the arrangement composed of the core provided with the envelope and running at high speed is not damaged and that the configuration that is obtained does not subsequently change or open up again.

DETAILED DESCRIPTION OF THE PREFERRED EMBODIMENTS

Figure 1:
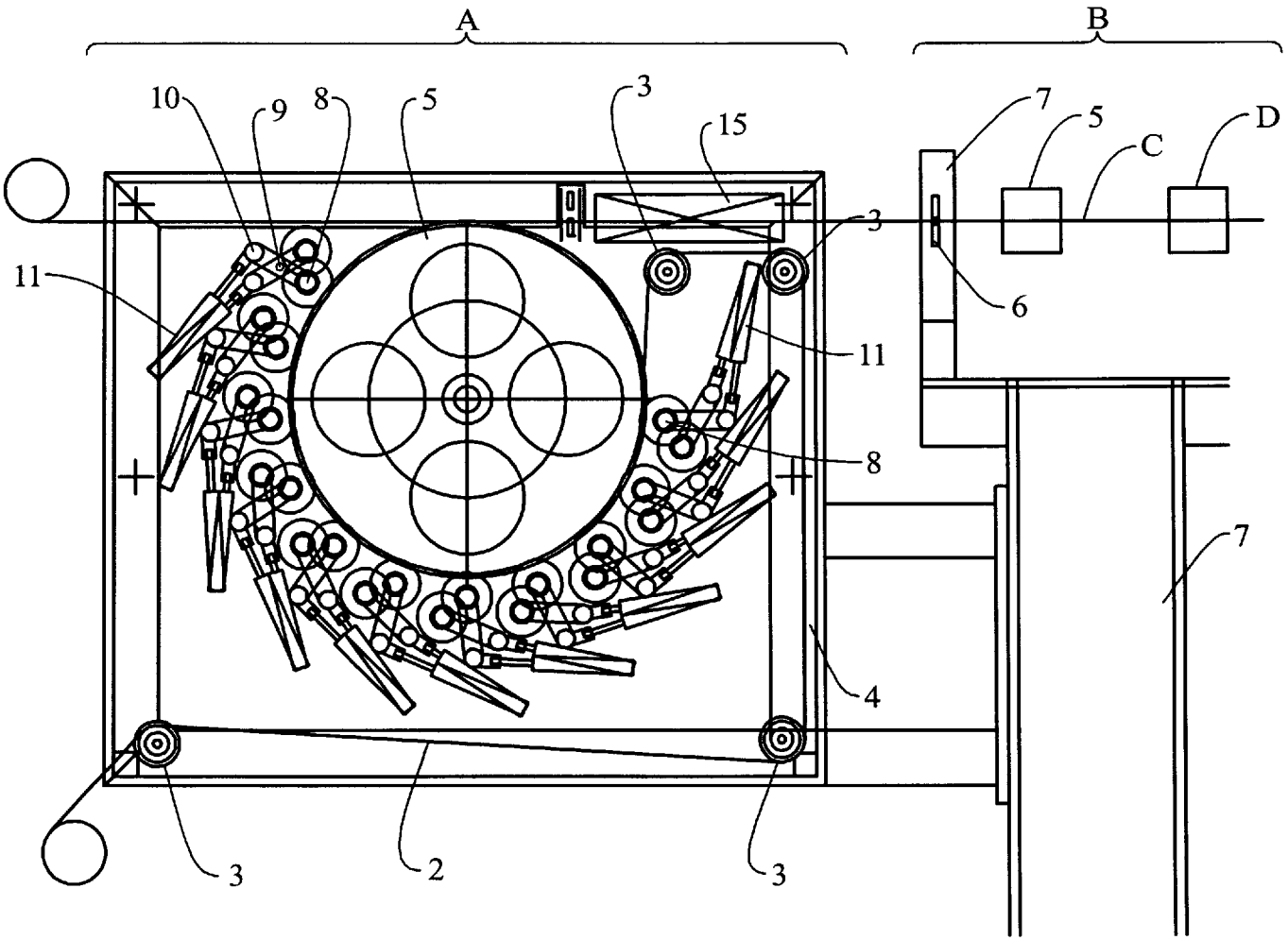
FIG. 1 shows a side view of the inventive system in the region of the delivery of the band-shaped material for the envelope.

The system for manufacturing cables, particularly conductor cables, comprises at least two sections A, B. In section A, a central core supplied along the path C through this section A, for example a central ground conductor of the cable, is provided with an envelope of paper. Subsequently, the final stranding, preferably an SZ-stranding, is undertaken in the section B at a well known stranding mechanism S and, at the very most, at least one further plastic cladding is also applied at P, for example by extrusion onto the stranded structure running through the system as is know in the art. Well known apparatus R is provided for pulling the central core (and hence the envelope) through sections A and B and is located downstream of Section B. To that end, a known stranding means S is attached on the carrier structure 1.

In the form of a long band of web-shaped material 2, the paper for the envelope is continuously supplied in section A, by a system whereby it runs over four deflection rollers 3 that are secured on a carrying frame 4. In addition to paper, of course, other materials and structures can be processed in the described way dependent on the application and demands. Thus, band-shaped metal foils or plastic films can also be employed or band-shaped weaves, fabrics, lays, nets or the like manufactured of said materials and also potentially impregnated with artificial resin or provided with adhesives.

Moving away from the last deflection roller 3, the band 2 runs onto an outer, preferably grooved surface of a guide roller 5 having a relatively large diameter and a thickness that preferably at least corresponds to the width of the band 2, so that this band 2 lies completely on the guide roller 5. The guide roller 5 is oriented parallel to the path C of the central core in the section A and is arranged so close to this path that the band 2, after lifting off from the guide roller 5, proceeds essentially parallel to the path C to a perforated disk 6 in a carrier 7 at the carrying structure 1 for the stranding means. A tangent at the guide roller 5 in the point at which the band 2 lifts off from this guide roller 5 proceeds essentially parallel to the path C of the central core of the cable at a slight distance therefrom. The ultimate form of the envelope composed of the band 2 is finished in this perforated disk 6 and the closed structure thereof is achieved, whereby, proceeding from the still essentially planar configuration of the band 2 on the guide roller 5, the band 2 is folded or bent farther and farther around the central core of the cable up to the passage through the perforated disk 6 until, finally, an envelope completely surrounding this core has been produced.

The expression "essentially planar configuration" does not relate to finer structures that are worked into the band 2 and are intended to enable or, respectively, facilitate the reshaping thereof into a closed envelope around the central core. In the illustrated embodiment of the inventive system, thus, eleven tools with shaping rollers 8 are provided along the part of the circumference of the guide roller 5 along which the band 2 lies on this guide roller 5. The shaping rollers 8 are attached freely rotatable around their own axis on lever arms 10 that can be pivoted onto the guide roller 5 or away therefrom around an axis 9. An actuator 11, potentially also a force store, for example a spring element, engages at the end of the lever arm 10 opposite the shaping roller 8 and produces a torque that presses the shaping roller 8 against the guide roller 5. The surface of each shaping roller 8 and/or the surface of the guide roller 5 is then fashioned such that longitudinal structures are worked into the band 2 running over the guide roller 5 while it lies against the guide roller 5, these longitudinal structures facilitating the bending or folding around the central core or being what enables this at all and also advantageously additionally assuring a fixing of the edges of the band 2—which are preferably placed on top of one another—after the production of a closed structure enveloping the core. Potentially, a device 15 for at least punctiform joining of the edges of the band 2 placed on top of one another can also be provided in the region following the guide roller 5 and, preferably, preceding the perforated disk 6. For example, a dispenser means for adhesive onto at least one of the edges, a basting means or the like could be present.

Figure 2:
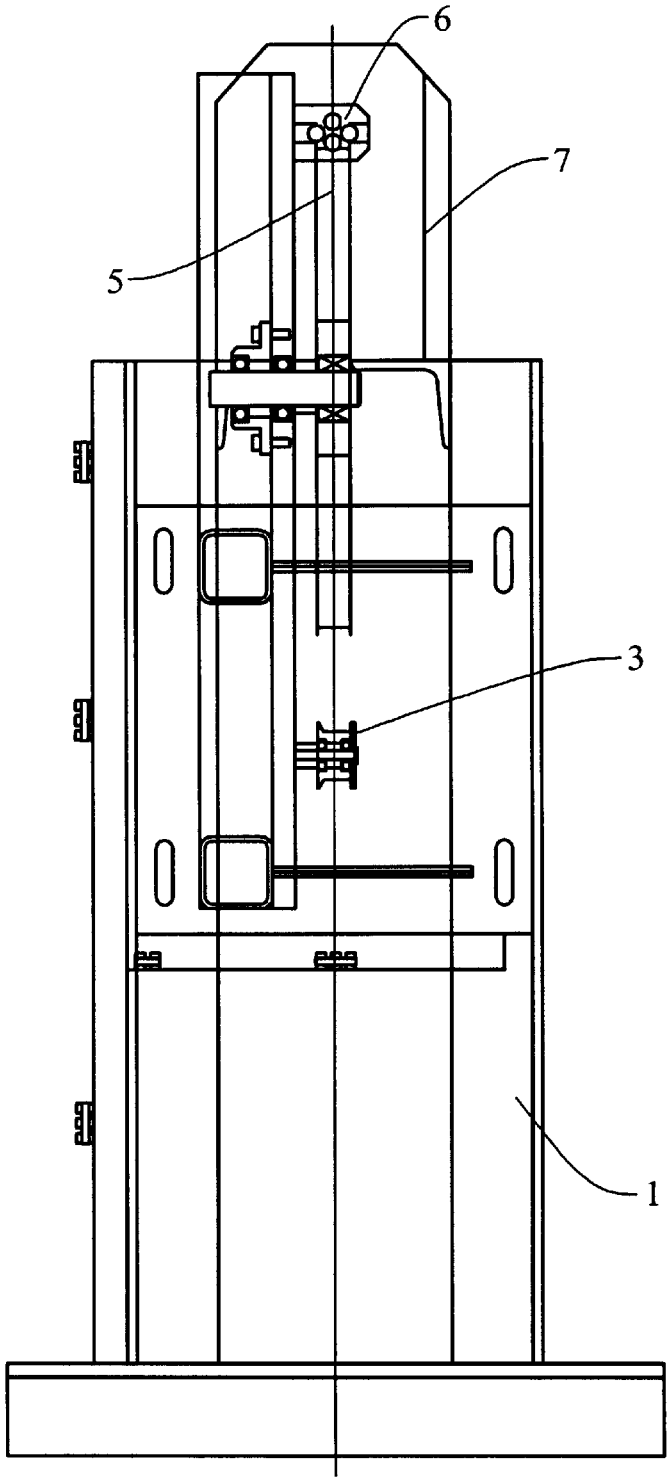
FIG. 2 is a front view of the system of FIG. 1, whereby the shaping rollers have been omitted for the sake of clarity.

FIG. 2 shows a front view of the section A of the inventive system wherein the parallel arrangement of guide roller 5 and path C to the perforated disk 6 can be clearly seen. The foremost and the lowest deflection roller 3 over which the band 2 enters into the system part A can likewise be seen.

Figure 3:
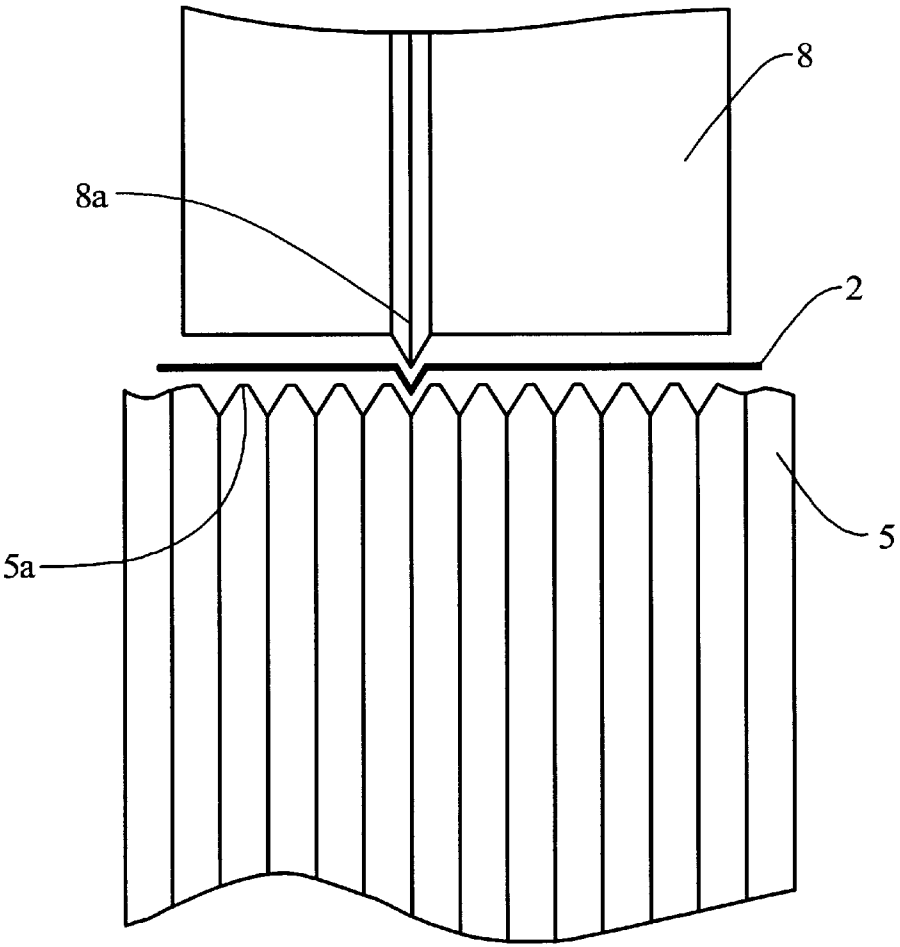
FIG. 3 shows a schematic cross section of the region in which a shaping roller collaborates with the guide roller.
Figure 4:
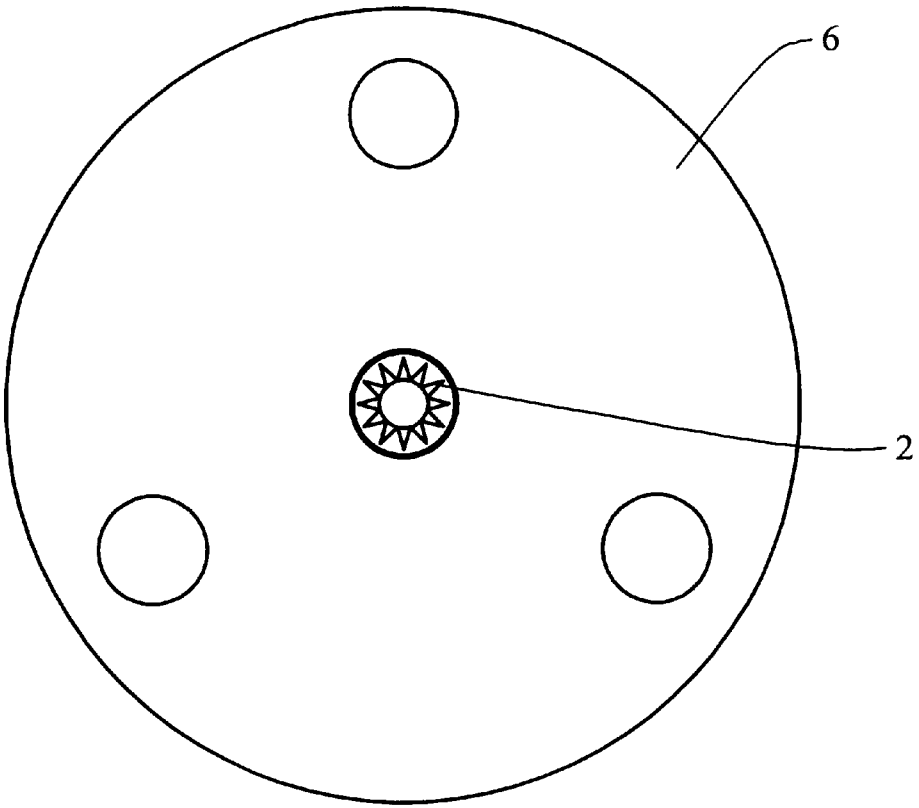
FIG. 4 is a view onto the shaping disk through which the central core, the envelope and—at the outside—the skeins for stranding are conducted.

A specific embodiment of the circumferential surfaces of the guide roller 5 and of the shaping roller 8 that collaborate with one another is shown in FIG. 3. On its circumferential surface, the guide roller 5 comprises grooves proceeding parallel to one another and limited by burrs 5*a,* these grooves exhibiting a v-shaped cross section in this example. Upon initial contact with the guide roller 5, the band 2 is essentially completely planar and proceeds planarly to the first shaping roller 8, which is provided with at least one structure at its circumferential surface that is shaped complementary to at least one of the grooves of the guide roller 5. In the illustrated example, this structure is a projection or burr 8*a* with a triangular cross section along the circumferential surface of the shaping roller 8 that engages into one of the grooves of the guide roller and works a corresponding groove into the band 2 as a longitudinal structure. A next shaping roller 8 has a burr at a location corresponding to a different groove of the guide roller 5, etc., so that each shaping roller 8, in collaboration with the guide roller 5, works at least one groove into the band 2, which, following the last shaping roller, comprises a plurality of grooves or, respectively, folds corresponding in number to the plurality of grooves in the guide roller 5 and can be bent or, respectively, folded around the central core at these folds. Preferably, at least one groove of an edge of the band 2 enters into engagement in a groove of the opposite edge, so that a meshing and, thus, fixing of the edges relative to one another derives no later than when passing the perforated disk 8, whose embodiment for this example is shown in FIG. 4. Of course, other shapes and arrangements of longitudinal structures can be effected in the band 2, for example only two longitudinal grooves that allow folding to form a hollow profile with a triangular cross section. Instead of being v-shaped, the grooves themselves can also be fashioned rounded off and can exhibit some other cross sectional shape; for example, a rounded-off corrugated cross sectional shape of the band after lifting off from the shaping roller 5 would be conceivable.

A plurality of burrs 8*a*—preferably not lying immediately next to one another, so that the stressing of the material is not unnecessarily increased—can also be provided on a shaping roller 8, so that fewer shaping rollers 8 than grooves in the guide roller 5 are provided. On the other hand, some or a few grooves can also be doubly or multiply processed, i.e. successively by a plurality of shaping rollers 8. Instead of shaping rollers 8, other types of tools could also be provided when the material that is employed allows it. Thus, comb-like structures or resiliently supported rods or, respectively, rods that are themselves resiliently fashioned can be provided as projections for engagement into the grooves of the guide roller 5 and that press the band 2 into the grooves of the guide roller 5 in grazing fashion. It would also be conceivable that, in particular, thicker bands 2 are processed successively or in alternation at their two sides, for example by two series-connected guide rollers 5 with corresponding shaping tools against which the band successively lies with, first, the one side and then the second side.

Figure 5:
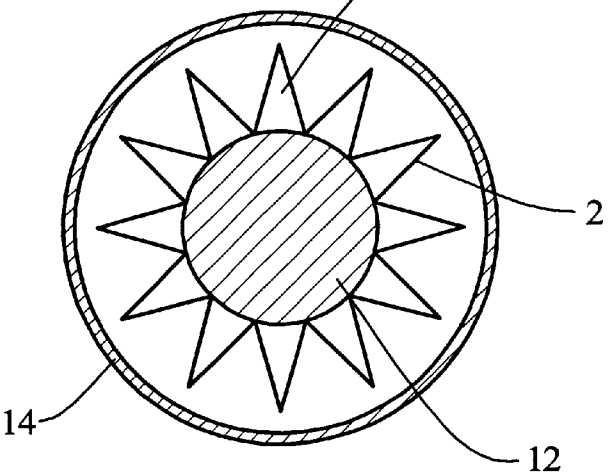
FIG. 5 shows a cross section through the enveloped core in a guide pipe.

FIG. 5, finally, shows a cross section through, for example, a central core such as a conductor 12 provided with the inventive band envelope 2 immediately at the location of the perforated disk 6 or, respectively, shortly after emerging therefrom and still before the application of the at least one stranding and the potential plastic cladding. The overlap of the inner envelope 2 over at least one of the grooves, here having the form of a triangular profile, can thereby be seen, as can an adhesive layer 13 that is advantageous for the dependable fixing of the overlap. Further, a guide pipe 14 preferably surrounding the arrangement composed of central core 12 and envelope 2 on all sides can also be seen, this extending from a location following the perforated disk 6, i.e. from a point where the completely closed configuration of the envelope 2 is essentially established, up to the following stranding machine or machines. Of course, other designs are conceivable as guide means, thus, for instance, partially open structures provided with openings distributed either longitudinally or circumferentially or grid-like over the circumference. Such a guidance of the arrangement composed of core 12 and envelope 2 is essentially advantageous for protecting it against damage and subsequent modification of the configuration given high-speed stranding systems, but is fundamentally advantageous given any type of system wherein a corresponding envelope 2 is produced. The inside of the guide pipe 14 or of any other guide means can be coated in order to reduce the friction, particularly given envelopes 2 that lie rather planarly over their circumference.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A method for manufacturing ropes or cables, whereby an envelope of a flexible, web-shaped material, is produced around at least one central core, moved in the direction of its longitudinal axis, and the structure that has arisen in this way is stranded in a traditional way while being moved, whereby at least one further layer of plastic material can also be applied onto the moving, stranded structure wherein material for the envelope is supplied in the form of a band with the same speed and is directed parallel to the core, wherein at least two longitudinal structures that are essentially parallel to one another and to the longitudinal axis of the band and that reduce the flexural strength of the band are worked into the band, and wherein the band, following the alignment parallel to the core and before the stranding, is automatically bent around the core at least twice at its longitudinal structures such that a closed sheath arises around the central core.

2. A method according to claim 1, wherein the longitudinal edges of the band lying opposite one another overlap after the bending around the core.

3. A method according to claim 2, wherein the longitudinal edges of the band overlapping one another are connected to one another, at least at points.

4. A method according to claim 1, wherein at least two grooves are produced in said band as said longitudinal structures.

5. A method according to claim 4, wherein a plurality of grooves are produced at both sides of the band and the band is thus multiply folded; and in wherein, during the course of the bending of the folded band around the core and the overlapping of the longitudinal edges, at least one groove of a longitudinal edge engages into a groove of a longitudinal edge lying opposite.

6. A method according to claim 5, wherein an overlap of a plurality of grooves is produced at both longitudinal edges.

7. A method according to claim 1, wherein grooves having a v-shaped cross section are formed.

8. A method according to claim 1, wherein the envelope of the band-shaped material that surrounds the central core and is already closed is guided on essentially all sides between at least one location at which the completely closed configuration has been essentially achieved and the entry into a following stranding means.

9. A method according to claim 1, wherein said web-shaped material comprises paper.

10. A method according to claim 1, wherein said central core comprises a conductor.

11. A method according to claim 1, wherein said stranding comprises SZ stranding.

12. A method according to claim 1, wherein said layer of plastic material is applied by extrusion.

13. An apparatus for the manufacture of ropes or cables, comprising a means for moving a central core, in the direction of its longitudinal axis, delivery means for a flexible, web-shaped material, in the immediate proximity of the moving core and parallel thereto, and comprising at least one following guide means for forming a closed envelope of the web-shaped material around the core, as well as a stranding mechanism, and, also at least one extrusion means for applying a further layer of plastic material onto the moving, stranded structure, wherein a guide roller oriented parallel to the moving direction of the core is provided for the band-shaped material, and in that at least one tool is provided that works at least two parallel, longitudinal structures into the band at least at one location at which the band lies on the guide roller.

14. An apparatus according to claim 13, wherein the circumferential surface of the guide roller on which the band lies is provided with at least one circumferential channel; and wherein the tool is composed of at least one shaping roller pressed against the circumferential surface of the guide roller, the circumferential surface of said at least one shaping roller being complementary to the circumferential channel in the guide roller.

15. An apparatus according to claim 14, wherein the circumferential surface of the guide roller comprises at least two circumferential grooves.

16. An apparatus according to claim 15, wherein at least two shaping rollers are provided, each single one thereof carrying at least one bead or burr along its circumference that engages into a respective circumferential groove of the guide roller and that is fashioned complementary to the circumferential grooves thereof, whereby the plurality and arrangement of the beads or burrs is selected such that each circumferential groove of the guide roller collaborates with at least one bead or burr.

17. An apparatus according to claim 16, wherein each shaping roller is provided with only one bead or burr and in that a plurality of shaping rollers corresponding in number to the plurality of circumferential grooves in the guide roller and distributed over the circumferential region is provided, the band also lying against the guide roller via said shaping rollers.

18. An apparatus according to claim 13, wherein the circumferential grooves comprise a v-shaped cross section, and the shaping rollers comprise corresponding beads having an angular cross section.

19. An apparatus according to claim 13, wherein at least one guide means is provided, in the form of a pipe that extends between essentially that location at which the envelope is essentially closed and the stranding means.

20. An apparatus according to claim 13, wherein said web-shaped material comprises paper.

21. An apparatus according to claim 13, wherein said central core comprises a conductor.

22. An apparatus according to claim 13, wherein said stranding mechanism comprises a SZ stranding mechanism.

23. A method for manufacturing ropes or cables having a central core and a surrounding envelope formed from a web-shaped material, comprising the steps of moving said central core in a direction of its longitudinal axis;

forming at least two longitudinal folding structures into said envelope material;

moving said envelope material in said direction of said central core longitudinal axis; and folding said envelope material along said folding structures such that said envelope material surrounds and encloses said central core.

24. A method according to claim 23, wherein said step of forming comprises supplying said envelope material to an outer surface of a guide roller having at least two parallel circumferential grooves and engaging said envelope material with at least one tool to press said material into said grooves to form said folding structures.

25. A method according to claim 23, wherein said step of folding comprises guiding said envelope material through a shaped opening to cause said material to fold along said longitudinal folding structures.

26. A method according to claim 23, wherein said steps of moving said central core and moving said envelope material comprises moving both at a same speed.

27. A method according to claim 23 including the further step of applying a layer of plastic material surrounding said envelope material and central core.

28. A method according to claim 27, wherein said plastic layer is applied via an extruder.

29. An apparatus for manufacturing ropes or cables having a central core and a surrounding envelope formed from a web-shaped material, comprising:

means for moving said central core in a direction of its longitudinal axis;

means for moving said envelope material at the same speed as said central core;

tools arranged to engage said moving envelope material to form at least two longitudinal folding structures into said envelope material;

guiding apparatus in engagement with said moving envelope material to align said moving envelope material with said moving central core; and further guiding apparatus in engagement with said moving envelope material at a location where said moving envelope material is aligned with said moving central core to effect a folding of said envelope material along said folding structures such that said envelope material surrounds and encloses said central core.

30. An apparatus according to claim 29, wherein said tools comprise a guide roller with an outer grooved surface against which one surface of said envelope material engages and a projection aligned with a first groove in said grooved surface and a projection aligned with at least a second parallel groove in said grooved surface, said projections engaging an opposite surface of said envelope material to press said envelope material into said grooves.

31. An apparatus according to claim 29, wherein said guiding apparatus comprises a guide roller having an outer surface to be engaged by said envelope material and said outer surface having a surface area aligned with said moving central core.

32. An apparatus according to claim 29, wherein said further guiding apparatus comprises a shaped opening for receiving said central core and surroundingly receiving said envelope material, with internal shapes formed in said opening to receive and guide said longitudinal folding structures formed in said envelope material.

33. An apparatus according to claim 29, including at least one extrusion means for applying a further layer of plastic material to surround and enclose said envelope material and central core.

* * * * *